US007507116B2

(12) United States Patent
Laerke et al.

(10) Patent No.: US 7,507,116 B2
(45) Date of Patent: Mar. 24, 2009

(54) COAXIAL CABLE CONNECTOR WITH COLLAPSIBLE INSERT

(75) Inventors: Per Rasmussen Laerke, Vordingborg (DK); Palle Sorensen, Hellerup (DK)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 11/644,298

(22) Filed: Dec. 22, 2006

(65) Prior Publication Data

US 2007/0155233 A1 Jul. 5, 2007

Related U.S. Application Data

(60) Provisional application No. 60/755,476, filed on Dec. 29, 2005.

(51) Int. Cl.
*H01R 9/05* (2006.01)

(52) U.S. Cl. ..... 439/584; 439/578

(58) Field of Classification Search ..... 439/578, 439/584–585
See application file for complete search history.

(56) References Cited

U.S. PATENT DOCUMENTS

| | | | | |
|---|---|---|---|---|
| 3,517,375 | A * | 6/1970 | Lloyd | 439/585 |
| 3,581,269 | A | 5/1971 | Frey et al. | 339/94 |
| 4,655,159 | A | 4/1987 | McMills | 116/212 |
| 4,963,104 | A | 10/1990 | Dickie | 439/460 |
| 5,073,129 | A * | 12/1991 | Szegda | 439/585 |
| 5,181,861 | A | 1/1993 | Gaver, Jr. et al. | 439/578 |
| 5,295,864 | A | 3/1994 | Birch et al. | 439/578 |
| 5,525,076 | A * | 6/1996 | Down | 439/585 |
| 5,879,191 | A | 3/1999 | Burris | 439/584 |
| 5,997,350 | A | 12/1999 | Burris et al. | 439/585 |
| 6,042,422 | A * | 3/2000 | Youtsey | 439/585 |
| 6,089,912 | A | 7/2000 | Tallis et al. | 439/584 |
| 6,331,123 | B1 * | 12/2001 | Rodrigues | 439/584 |
| 6,780,052 | B2 | 8/2004 | Montena et al. | 439/578 |
| 6,805,583 | B2 | 10/2004 | Holliday et al. | 439/578 |
| 6,884,115 | B2 * | 4/2005 | Malloy | 439/584 |
| 6,887,103 | B2 | 5/2005 | Montena et al. | 439/583 |
| 6,971,912 | B2 | 12/2005 | Montena et al. | 439/578 |
| 7,112,093 | B1 | 9/2006 | Holland | 439/585 |
| 7,128,603 | B2 * | 10/2006 | Burris et al. | 439/578 |
| 7,182,639 | B2 * | 2/2007 | Burris | 439/584 |

* cited by examiner

*Primary Examiner*—Truc T Nguyen
(74) *Attorney, Agent, or Firm*—Joseph M. Homa; Matthew J. Mason

(57) ABSTRACT

A connector for coaxial cable is disclosed herein that has an outer body and a collapsible insert. The insert grips the outermost protective layer of the cable when the insert is fully compressed. A related method for connecting the coaxial cable and connector is also disclosed.

15 Claims, 7 Drawing Sheets

COAXIAL CABLE CONNECTOR WITH COLLAPSIBLE INSERT

BACKGROUND OF THE INVENTION

This application claims the benefit of priority under 35 U.S.C. § 119(e) of U.S. Provisional Application Ser. No. 60/755,476 filed on Dec. 29, 2005.

FIELD OF THE INVENTION

The present invention relates generally to coaxial cable connectors, and particularly to coaxial drop cable connectors.

TECHNICAL BACKGROUND

Coaxial cable connectors such as F-connectors are used to attach coaxial cables to another object such as an adapter or such as an appliance or junction having a terminal adapted to engage the coaxial cable connector. Coaxial cable F-connectors are often used to terminate a drop cable in a cable television system. The coaxial cable typically includes a center conductor surrounded by a dielectric, in turn surrounded by a conductive grounding foil and/or braided shield, hereinafter collectively referred to as the outer conductor; the outer conductor is in turn surrounded by a protective outer jacket. The F-connector is secured over a prepared end of a jacketed coaxial cable, allowing the end of the coaxial cable to be connected with a terminal block, such as by a threaded connection with a threaded terminal of a terminal block, or with an adapter such as a female adapter that accepts the center conductor of the cable and has threads for threaded connection with the F-connector.

Coaxial cable connectors can be installed on the coaxial cable by crimping the coaxial cable connector to the cable or by axial compression. These compression connectors are installed onto prepared cables by inserting the exposed cable core (conductive grounding foil and dielectric and center conductor) into the connector and, more specifically, onto a post (or mandrel or support sleeve) on the inside of the coaxial cable connector. The braided shield is typically folded back over the protective outer jacket when the cable core is exposed. The post is interposed between the cable core (conductive grounding foil and dielectric and center conductor) and the braided shield. In certain coaxial cables, specifically head end cables (HEC), there may be multiple layers of conductive grounding foil and braided shield. The multiple layers of conductive grounding foil and braided shield cause the HEC cable to have a larger diameter than the typical coaxial cables, thereby making insertion of the prepared coaxial cable into the typical F-connectors difficult if not impossible. Thus, the termination of the HEC coaxial cables is extremely difficult, if not close to impossible, using standard techniques and materials.

Various types of coaxial cable have different outer protective layers or jackets.

FIG. 1 illustrates in cross-section a known coaxial cable 10 comprising an inner conductor 12 surrounded by a dielectric layer 14; in turn, dielectric layer is surrounded by a conductive grounding foil 15 surrounded by a braided shield 16 which is covered by a protective outer cable jacket or protective layer 18. Foil 15 and shield 16 can be collectively referred to as the outer conductor 17 of the cable 10.

FIGS. 2 and 3 illustrate in cross-section a known connector, designated generally by reference numeral 25, such as described in U.S. Pat. No. 5,997,350 to Burris et al. Connector 25 includes a tubular post 32 having a first end 34 adapted to be inserted into the exposed end of coaxial cable 10 around the dielectric 14 and conductive grounding foil 15 thereof and under the braided shield 16. Tubular post 32 has an opposing second end 36. Connector 20 also includes a nut 38 having a first end 40 for rotatably engaging second end 36 of tubular post 32 and having an opposing second end 42 with an internally threaded bore 44 for threadedly engaging a threaded port (not shown). Connector 20 further includes a cylindrical body member 46 having a first end 48 and a second end 50. First end 48 of cylindrical body member 46 includes a cylindrical sleeve 52 having an outer wall 54 and an inner wall 56 bounding a first central bore 58 extending about tubular post 32. Second end 50 of cylindrical body member 46 is of a smaller diameter than first end 48 thereof, and engages tubular post 32 proximate its second end 36. Cylindrical sleeve 52 has an open rear end portion 60 for receiving the outer jacket 18 of coaxial cable 10; this rear end portion 60 is deformable. Cylindrical sleeve 52 has a circular relief, or weakened area 62, formed therein as by cutting a circular groove thereabout, to facilitate bending of cylindrical sleeve 52 at such point. Connector 20 also includes a compression ring 64 having a first end 66 and an opposing second end 68. A central passageway 70 extends through compression ring 64 between first end 66 and second end 68. A portion of central passageway 70 is formed by a first internal bore 72 communicating with the first end 66 of compression ring 64. Central passageway 70 of compression ring 64 also includes an inwardly tapered annular wall 74 leading from first internal bore 72 and narrowing to a reduced diameter as compared with the internal diameter of first internal bore 72. This inwardly tapered annular wall 74 causes the rear end portion 60 of cylindrical sleeve 52 to be deformed inwardly toward tubular post 32 and against cable jacket 18, as shown in FIG. 3, as compression ring 64 is advanced axially over cylindrical body member 46 toward the second end 50 thereof. Tubular post 32 has a circular barb 76 formed thereabout proximate its first end 34. Cylindrical sleeve 52 initially extends axially to a point proximate circular barb 76.

FIG. 4 is illustrative of an end of cable 10 prepared for use with the connector 25 of FIGS. 2 and 3. The braided shield 16 is pulled back over the protective layer 18. A portion of the outer cylindrical surface of the conductive grounding foil 15 is exposed, and a portion of the outer cylindrical surface of the inner conductor 12 is also exposed.

SUMMARY OF THE INVENTION

Disclosed herein is a method of coupling a coaxial cable to a connector, the coaxial cable comprising an inner conductor, a dielectric surrounding the inner conductor, an outer conductor surrounding the dielectric, and a protective layer surrounding the outer conductor, the cable further comprising a prepared end having an exposed outer conductor and an exposed inner conductor, the connector comprising an outer body and a collapsible insert at least partially disposed within the outer body, the insert comprising a rearward facing shoulder, a rear ferrule portion, a weakened portion adjacent the rear ferrule portion, a bushing portion adjacent the weakened portion, and a forward conducting portion disposed adjacent the bushing portion, the method comprising: (a) inserting the prepared end of the cable into a rear end of the connector until the front end of the protective layer of the cable engages the rearward facing shoulder; (b) longitudinally compressing the insert, thereby causing the insert to collapse, and causing the rear ferrule portion to engage the protective layer, and causing the forward conducting portion to engage the exposed outer conductor. The insert is longitudinally compressible and generally tubular.

Longitudinally compressing the insert causes the weakened portion of the insert to collapse. The longitudinal compression can cause the weakened portion to break, fold, bend, stretch, or otherwise deform.

In some embodiments, at least part of the rear ferrule portion is disposed in a first plane perpendicular to the longitudinal axis and at least part of the bushing portion is disposed in the first plane after the step of longitudinally compressing the insert.

In some embodiments, at least part of the exposed outer conductor remains directly adjacent to the dielectric during the inserting and during the compressing.

The protective layer is not forced away from the outer conductor of the cable during the inserting, and is not forced away from the outer conductor of the cable during the compressing.

In some embodiments, the compressing step comprises engaging a front end of the insert and the rear end of the outer body with a tool and longitudinally compressing the insert towards the rear end of the outer body.

In other embodiments, the outer body comprises at least one thread, and the compressing step comprises threadedly engaging the outer body with a threaded terminal, wherein advancement of the outer body onto the terminal causes the terminal to engage and longitudinally compress the insert towards the rear end of the outer body.

In some embodiments, the outer body comprises at least one thread, and the compressing step comprises threadedly engaging the outer body with a threaded device, wherein movement together of the outer body and the threaded device causes the device to engage and longitudinally compress the insert towards the rear end of the outer body.

In some embodiments, longitudinal compression of the insert causes part of the cable to egress from the rear end of the connector.

In some embodiments, the outer surface of the forward conducting portion of the insert comprises at least one circumferential compression groove, and longitudinally compressing the insert causes the forward conducting portion to longitudinally compress at or proximate the circumferential compression groove, thereby causing the inner surface of the forward conducting portion of the insert at or proximate the circumferential compression groove to protrude radially inwardly.

Preferably, the internal surface of the outer body comprises an inward protrusion disposed between the rear end and the front end, wherein the inward protrusion is capable of engaging the outer surface of the insert, thereby providing a forward stop to longitudinal movement of the insert and the cable toward the front end of the outer body.

Preferably, the inner surface of the insert defines a rearward facing shoulder at or proximate the junction between the bushing portion and the forward conducting portion, and the front edge of the protective layer engages the rearward facing shoulder.

Also disclosed herein is a connector for attaching to an end of a coaxial cable, the coaxial cable comprising an inner conductor, a dielectric surrounding the inner conductor, an outer conductor surrounding the dielectric, and a protective layer surrounding the outer conductor. The connector comprises: an outer body comprising a rear end, an inwardly directed rear flange, a front end, a longitudinal axis, and an internal surface extending between the rear and front ends of the body, the internal surface defining a longitudinal opening, wherein the inwardly directed rear flange defines an forward facing shoulder in the internal surface; and a collapsible insert disposed at least partially within the longitudinal opening of the outer body, the insert comprising an inner surface defining a longitudinal opening, an outer surface, a rear ferrule portion, a weakened portion adjacent the rear ferrule portion, a bushing portion adjacent the weakened portion, and a forward conducting portion disposed adjacent the bushing portion. In an uncompressed state, the weakened portion is disposed between the ferrule portion and the bushing portion, and the bushing portion is longitudinally spaced away from the ferrule portion. In a fully compressed state, the rear ferrule portion abuts the forward facing shoulder of the outer body, the weakened portion is deformed and/or broken, and at least part of the bushing portion is sandwiched between the ferrule portion and the internal surface of the outer body, thereby urging the ferrule portion radially inwardly. Preferably, at least a rear part of the bushing portion is not longitudinally spaced away from the ferrule portion in the fully compressed state. The insert is longitudinally compressible and generally tubular.

The insert is capable of abutting and being compressed against the forward facing shoulder of the outer body, the forward facing shoulder of the outer body thereby providing a rearward stop to longitudinal movement of the insert toward the rear end of the outer body.

In some embodiments, the outer surface of the forward conducting portion of the insert comprises at least one circumferential compression groove, and, in the fully compressed state, the forward conducting portion is longitudinally compressed at or proximate the circumferential compression groove and the inner surface of the forward conducting portion of the insert at or proximate the circumferential compression groove protrudes radially inwardly.

Preferably, the internal surface of the outer body comprises an inward protrusion disposed between the rear end and the front end, wherein the inward protrusion is capable of engaging the outer surface of the insert, thereby providing a forward stop to longitudinal movement of the insert toward the front end of the outer body.

Preferably, the inner surface of the insert defines a rearward facing shoulder at or proximate the junction between the bushing portion and the forward conducting portion.

In some embodiments, the rear ferrule portion, the weakened portion, and the bushing portion are a single unitary piece. The single unitary piece may comprise plastic, metal, or metallized plastic, or some combination thereof. In some embodiments, the forward conducting portion comprises metal.

In other embodiments, the rear ferrule portion, the weakened portion, the bushing portion, and the forward conducting portion are a single unitary piece, and the single unitary piece comprises metal.

Movement of the insert toward the rear end of the outer body causes the rear ferrule portion to engage the forward facing shoulder of the outer body, and causes the weakened portion to deform or to break, and causes the bushing portion to move longitudinally toward the rear end of the outer body.

In some embodiments, the rear ferrule portion comprises a tapered, or conical, outer surface of increasing diameter in the rearward direction. Thus, movement of the insert toward the rear end of the outer body causes the rear ferrule portion to engage the forward facing shoulder of the outer body, and causes the weakened portion to deform or to break, and causes the bushing portion to move longitudinally toward the rear end of the outer body and to ride on the tapered or conical outer surface of the rear ferrule portion in these embodiments.

In some embodiments, movement of the insert toward the rear end of the outer body causes the forward conducting portion of the insert to longitudinally compress and cause the inner surface of the forward conducting portion of the insert to protrude radially inwardly.

In some embodiments, the internal surface of the outer body comprises one or more threads. In some embodiments, the internal surface of the outer body comprises at least one thread on at least a portion of the internal surface adjacent the front end of the outer body.

In some embodiments, the insert fits entirely within the longitudinal opening of the outer body in the uncompressed state. In some embodiments, the insert fits entirely within the longitudinal opening of the outer body in the fully compressed state.

In some embodiments, the insert fits entirely within the longitudinal opening of the outer body in both the fully compressed state and the uncompressed state.

Also disclosed herein is a connector in combination with a coaxial cable, the coaxial cable comprising an inner conductor, a dielectric surrounding the inner conductor, an outer conductor surrounding the dielectric, and a protective layer surrounding the outer conductor, the protective layer having an outermost cable diameter, the cable further comprising a prepared end having an exposed outer conductor and an exposed inner conductor. The combination comprises: an outer body comprising a rear end, an inwardly directed rear flange, a front end, a longitudinal axis, and an internal surface extending between the rear and front ends of the body, the internal surface defining a longitudinal opening adapted to receive the cable and comprising at least one thread on at least a portion of the internal surface adjacent the front end of the outer body, wherein the inwardly directed rear flange defines an forward facing shoulder in the internal surface; and a collapsible insert disposed at least partially within the longitudinal opening of the outer body, the insert comprising an inner surface defining a longitudinal opening, an outer surface, a rear ferrule portion, a weakened portion adjacent the rear ferrule portion, a bushing portion adjacent the Weakened portion, and a forward conducting portion disposed adjacent the bushing portion. In an uncompressed state: the weakened portion is disposed between the ferrule portion and the bushing portion; the bushing portion is longitudinally spaced away from the ferrule portion; the rear ferrule portion, the weakened portion and the bushing portion are disposed between the internal surface of the outer body and the protective layer of the cable; and the forward conducting portion is disposed adjacent the exposed outer conductor and between the exposed outer conductor and the internal surface of the outer body. In a fully compressed state, the rear ferrule portion abuts the forward facing shoulder of the outer body, the weakened portion is deformed or broken, and at least a rear part of the bushing portion is sandwiched between the ferrule portion and the internal surface of the outer body, thereby urging the ferrule portion radially inwardly into the protective layer of the cable. In the fully compressed state, at least a rear part of the bushing portion is preferably not longitudinally spaced away from the ferrule portion.

The protective layer and at least a portion of the internal surface of the outer body define a first annular cavity therebetween. The rear ferrule portion, the weakened portion, and the bushing portion are disposed in the first annular cavity. The exposed outer conductor and at least a portion of the internal surface of the outer body define a second annular cavity therebetween. The forward conducting portion is disposed in the second annular cavity.

In the fully compressed state, at least part of the forward conducting portion protrudes radially inwardly against the exposed outer conductor of the cable. The outer surface of the forward conducting portion of the insert comprises at least one circumferential compression groove, and, in the fully compressed state, the forward conducting portion is longitudinally compressed at or proximate the circumferential compression groove and the inner surface of the forward conducting portion of the insert at or proximate the circumferential compression groove protrudes radially inwardly against the exposed outer conductor of the cable.

The inner surface of the insert defines a rearward facing shoulder at or proximate the junction between the bushing portion and the forward conducting portion. The rearward facing shoulder is capable of engaging a front end of the protective layer of the cable, thereby providing a forward stop to longitudinal movement of the cable toward the front end of the insert.

Movement of the insert toward the rear end of the outer body causes the cable to move toward the rear of the outer body, causes the rear ferrule portion to engage the forward facing shoulder of the outer body, causes the weakened portion to deform or break, and causes the bushing portion to move longitudinally toward the rear end of the outer body.

Movement of the insert toward the rear end of the outer body causes the cable to move toward the rear of the outer body, causes the rear ferrule portion to engage the forward facing shoulder of the outer body, causes the weakened portion to deform or break, and causes the bushing portion to move longitudinally toward the rear end of the outer body and to ride on the tapered or conical outer surface of the rear ferrule portion.

Movement of the insert toward the rear end of the outer body causes the forward conducting portion of the insert to longitudinally compress and cause the inner surface of the forward conducting portion of the insert to protrude radially inwardly and against the exposed outer conductor.

Also disclosed herein is a connector for attaching to an end of a coaxial cable, the coaxial cable comprising an inner conductor, a dielectric surrounding the inner conductor, an outer conductor surrounding the dielectric, and a protective layer surrounding the outer conductor. The connector comprises: an outer body comprising a rear end, an inwardly directed rear flange, a front end, a longitudinal axis, and an internal surface extending between the rear and front ends of the body, the internal surface defining a longitudinal opening and having at least one thread on at least a portion of the internal surface adjacent the front end of the outer body, wherein the inwardly directed rear flange defines an forward facing shoulder in the internal surface; and a collapsible insert disposed at least partially within the longitudinal opening of the outer body, the insert comprising an inner surface defining a longitudinal opening, an outer surface, a rear ferrule portion, a bushing portion, a weakened portion disposed between the ferrule portion and the bushing portion, and a forward conducting portion disposed adjacent the bushing portion. In an uncompressed state, the weakened portion is disposed between the ferrule portion and the bushing portion, and the bushing portion is longitudinally spaced away from the ferrule portion. The longitudinally compressible generally tubular insert is capable of abutting and being compressed against the forward facing shoulder of the outer body. In a fully compressed state, the rear ferrule portion abuts the forward facing shoulder of the outer body, the weakened portion is deformed or broken, and at least a rear part of the bushing portion is sandwiched between the ferrule portion and internal surface of the outer body, thereby urging the ferrule portion radially inwardly. Preferably, at least a rear part of the bushing portion is not longitudinally spaced away from the ferrule portion.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1:
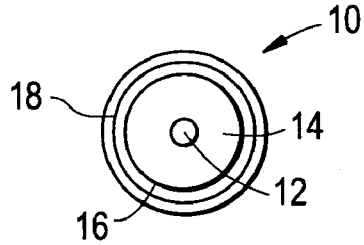
FIG. 1 PRIOR ART
FIG. 1 is a cross-sectional representation of a known coaxial cable.

Reference will now be made in detail to the present preferred embodiment(s) of the invention, examples of which are illustrated in the accompanying drawings. Whenever possible, the same reference numerals will be used throughout the drawings to refer to the same or like parts.

Figure 2:
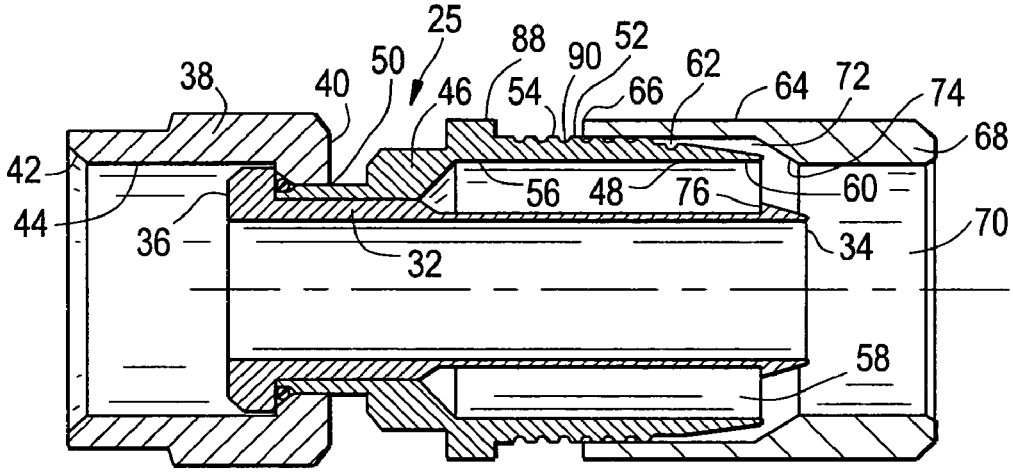
FIG. 2 PRIOR ART
FIG. 2 is a side cutaway view of a known coaxial cable connector in an uncompressed state.
Figure 3:
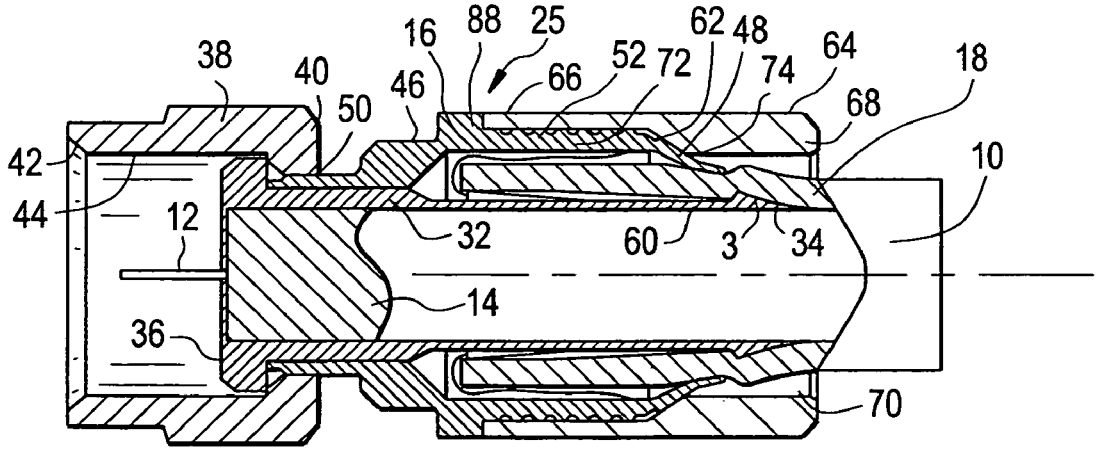
FIG. 3 PRIOR ART
FIG. 3 is a side cutaway view of the known connector of FIG. 2 in a fully compressed state.
Figures 4, 5:
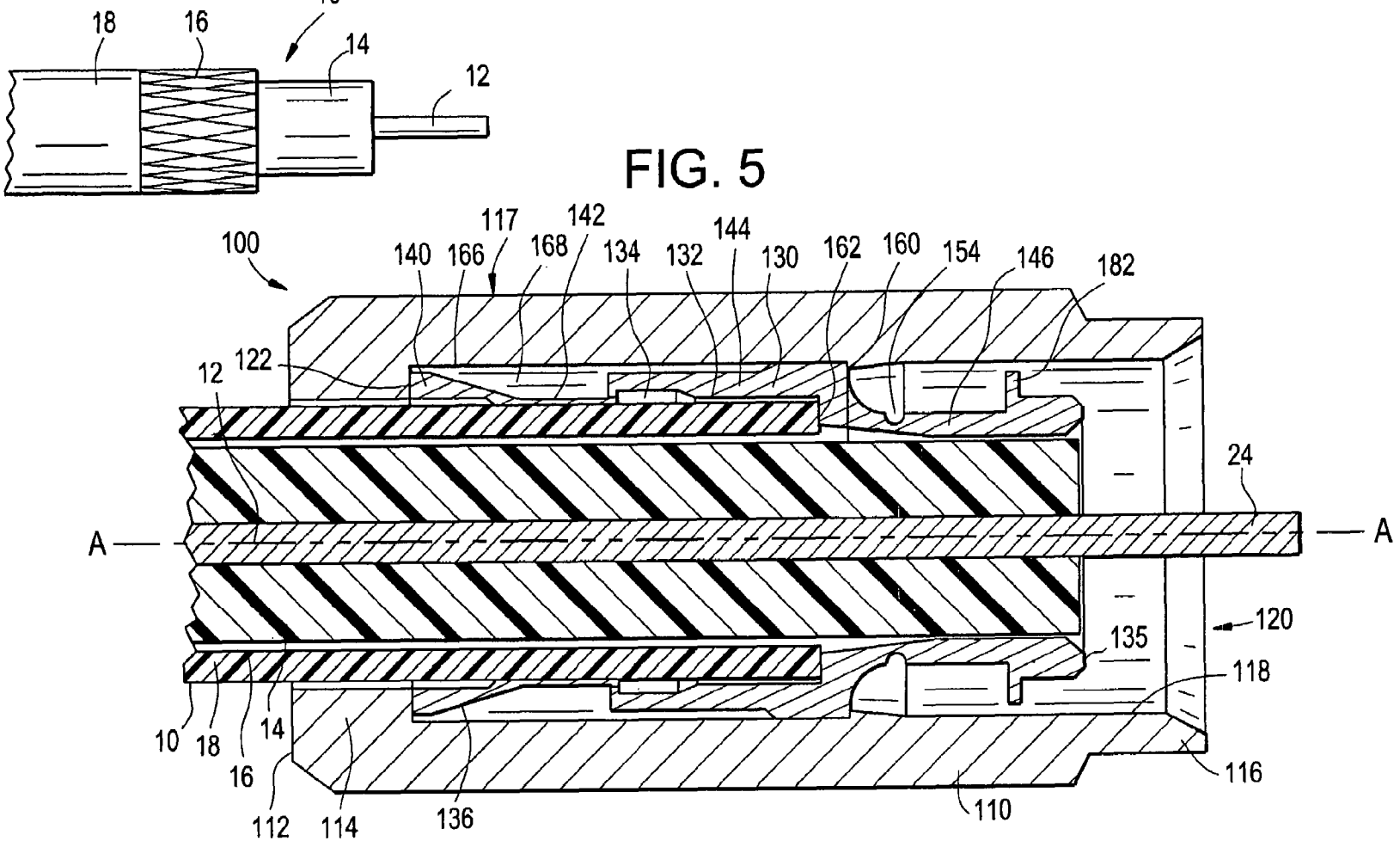
FIG. 4 PRIOR ART
FIG. 4 schematically illustrates a known cable prepared for use with the known connector of FIGS. 2 and 3.
FIGS. 5-7 illustrate a first embodiment of the coaxial cable connector disclosed herein.
Figure 6:
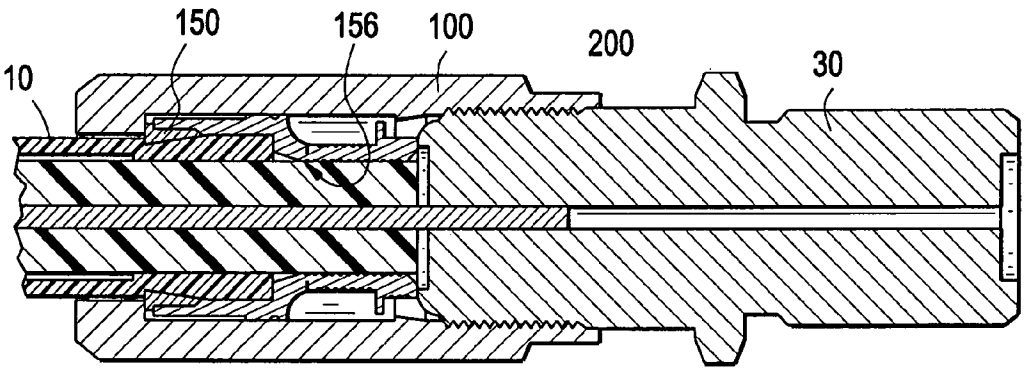
Figure 8:
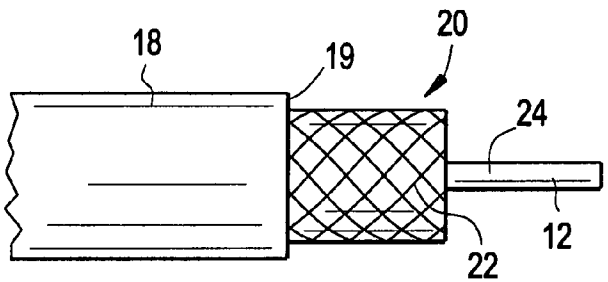
FIG. 8 illustrates a known cable prepared for use with the connectors disclosed herein.
Figure 7:
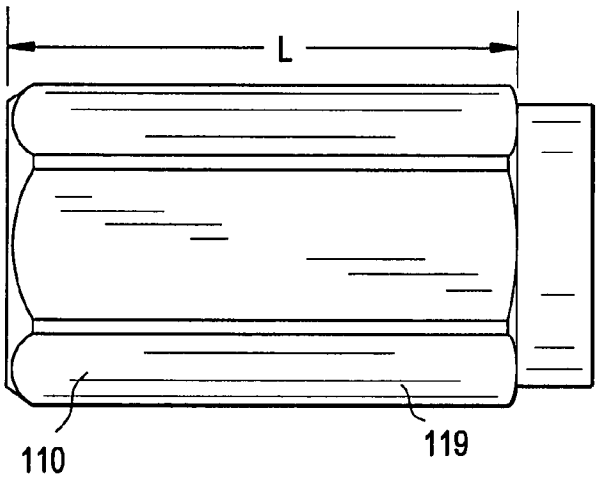
Figure 9:
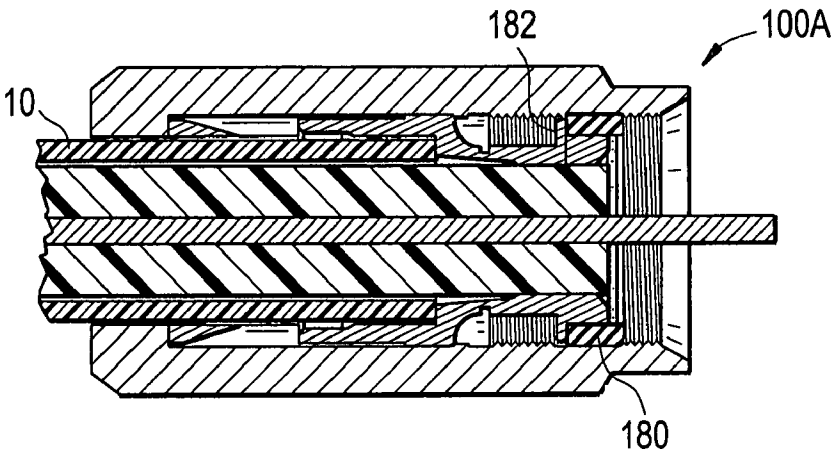
FIGS. 9-10 illustrate a second embodiment of a coaxial cable connector as disclosed herein.
Figure 10:
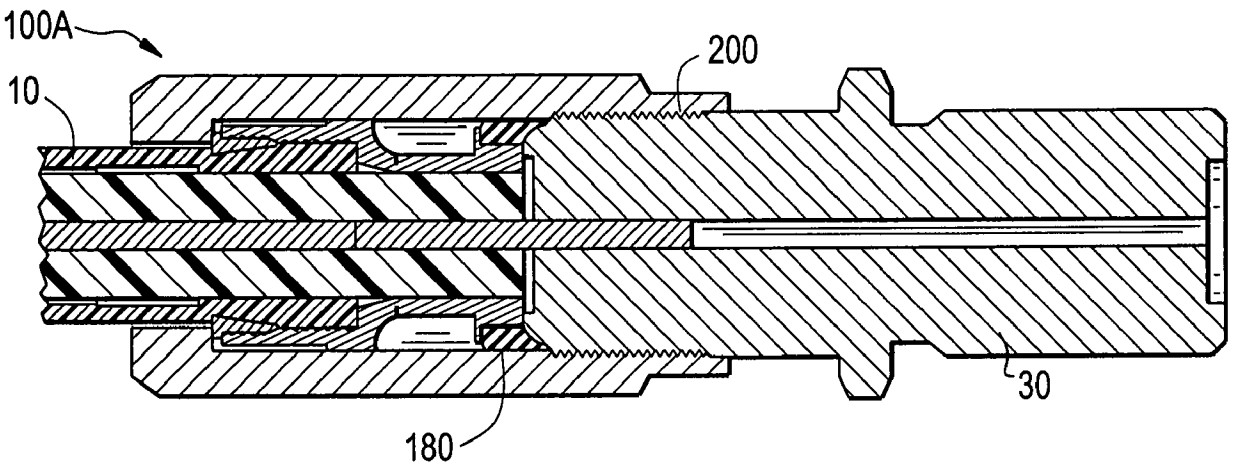
Figure 11:
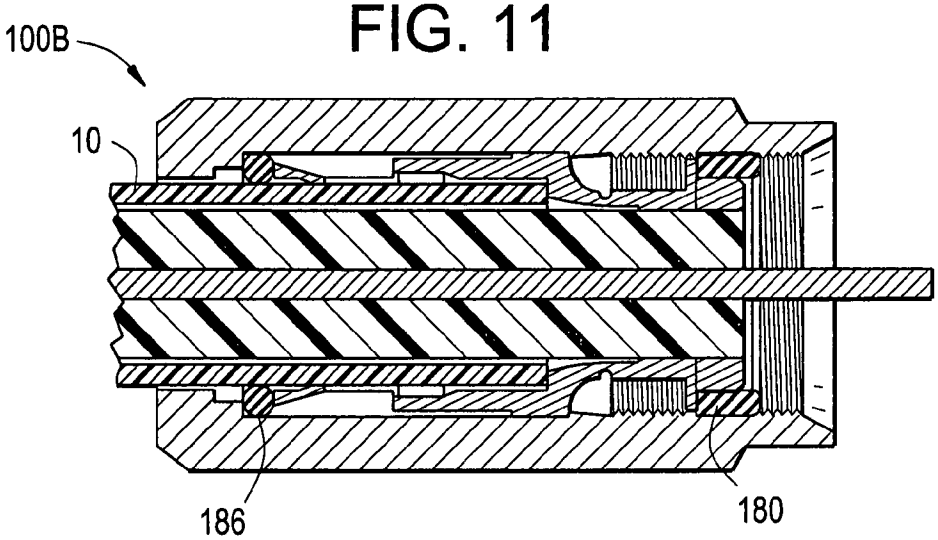
FIGS. 11-12 illustrate a third embodiment of a coaxial cable connector as disclosed herein.
Figure 12:
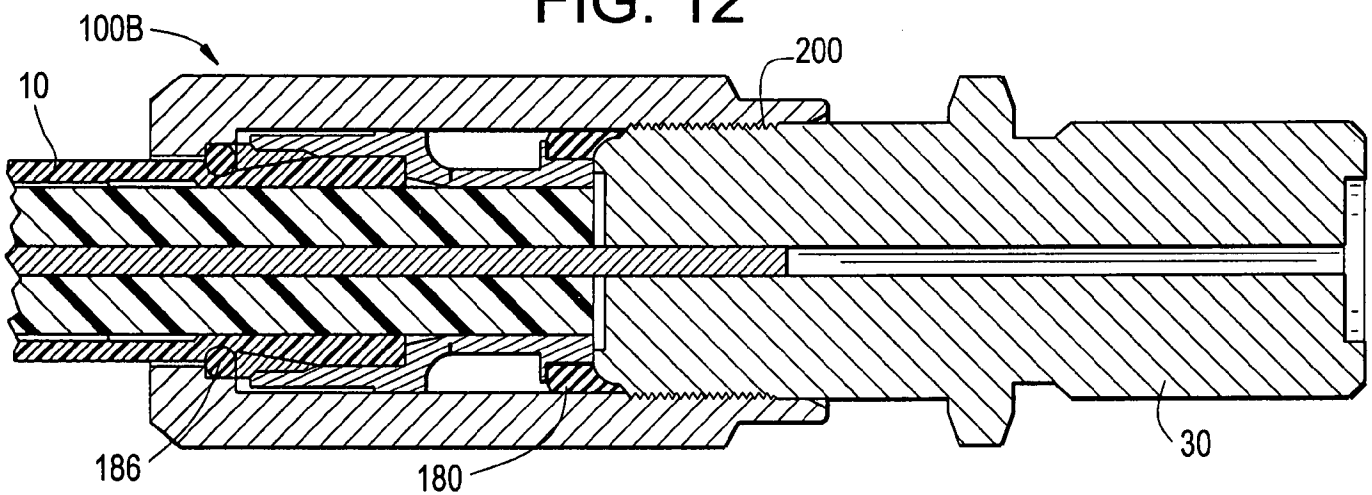
Figure 13:
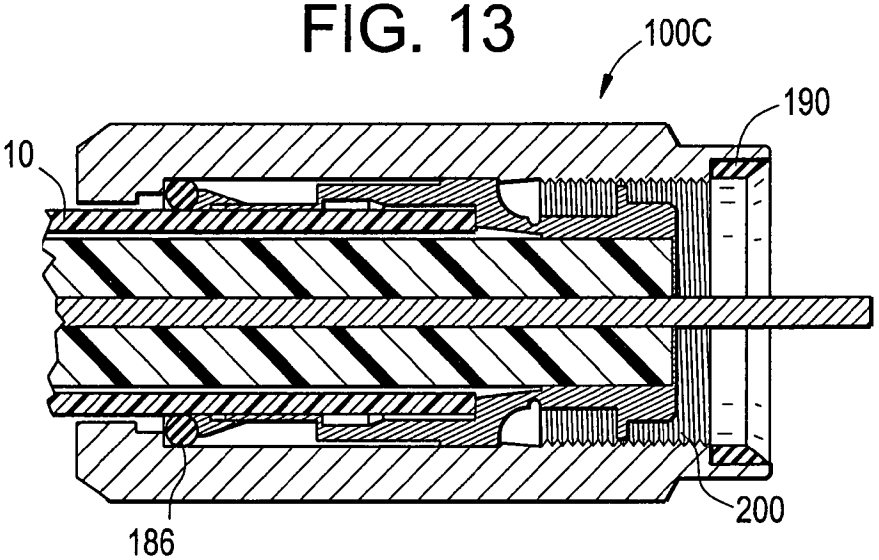
FIGS. 13-14 illustrate a fourth embodiment of a coaxial cable connector as disclosed herein.
Figure 14:
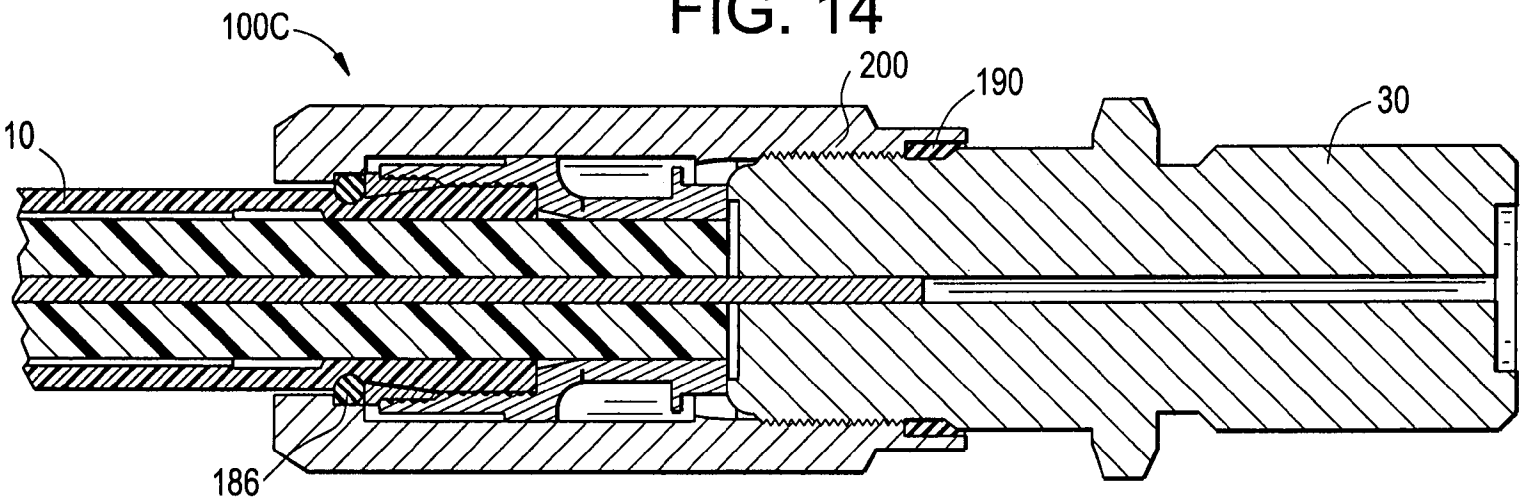
Figure 15:
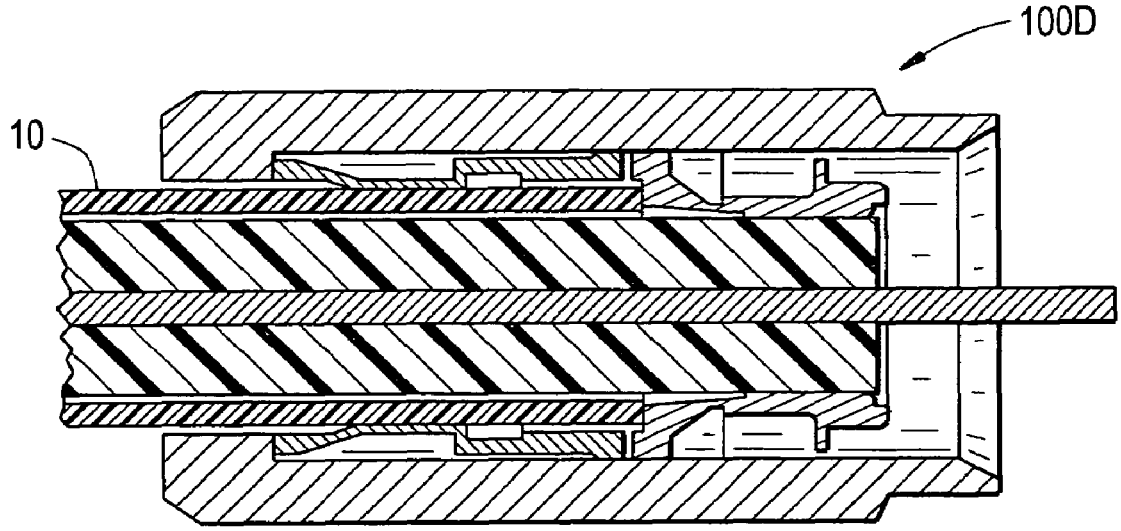
FIG. 15 illustrates a fifth embodiment of a coaxial cable connector as disclosed herein.

FIG. 1 schematically illustrates in cross-section a known coaxial cable 10. FIGS. 2-3 schematically illustrate a known coaxial cable connector 25. FIG. 4 schematically illustrates a known cable prepared for use with a known connector. FIGS. 5-7 illustrate a first embodiment of the coaxial cable connector disclosed herein. FIG. 8 illustrates a known cable prepared for use with the connectors disclosed herein. FIGS. 9-10 illustrate a second embodiment of a coaxial cable connector as disclosed herein. FIGS. 11-12 illustrate a third embodiment of a coaxial cable connector as disclosed herein. FIGS. 13-14 illustrate a fourth embodiment of a coaxial cable connector as disclosed herein. FIG. 15 illustrates a fifth embodiment of a coaxial cable connector as disclosed herein.

Representative of a first set of embodiments, coaxial cable connector 100 is schematically illustrated in FIGS. 5-7. Coaxial cable connector 100 has a longitudinal axis A-A and a hollow outer body 110. The outer body comprises a rear end 112, an inwardly directed rear flange 114 at the rear end 112, a front end 116, and an internal surface 118 extending between the rear and front ends 112, 116 of the body 110. The internal surface 118 defines a longitudinal opening 120 that extends all the way through the outer body 110. The inwardly directed rear flange 114 defines a forward facing shoulder 122 in the internal surface 118.

A collapsible, longitudinally compressible, insert 130 is disposed at least partially within the longitudinal opening 118 of the outer body 110. In FIGS. 5-7, the insert 130 is disposed entirely within the longitudinal opening 118. The insert 130 is generally tubular. The insert 130 comprises an inner surface 132 defining a longitudinal opening 140, an outer surface 136, a rear ferrule portion 140, a weakened portion 142 adjacent the rear ferrule portion 140, a bushing portion 144 adjacent the weakened portion 142, and a forward conducting portion 146 disposed adjacent the bushing portion 144.

In some embodiments, the weakened portion 142 comprises a reduced wall thickness. In other embodiments, the weakened portion 142 comprises a plurality of slits or holes. In still other embodiments, the weakened portion 142 comprises a material that is more ductile, or more easily deformed, than the bushing portion. Other embodiments comprise two or more of these features together.

As seen in FIG. 5, the insert 130 is capable of abutting, and being compressed against, the forward facing shoulder 122 of the outer body 110. The forward facing shoulder 122 of the outer body 110 thereby provides a rearward stop to longitudinal movement of the insert 110 toward the rear end 112 of the outer body 110.

FIG. 5 shows the connector 100 in an uncompressed state. The weakened portion 142 is disposed between the ferrule portion 140 and the bushing portion 144, and the bushing portion 144 is longitudinally spaced away from the ferrule portion 140.

FIG. 8 schematically illustrates coaxial cable 10 that comprises an inner conductor 12, a dielectric 14 surrounding the inner conductor 12, an outer conductor 17 surrounding the dielectric 14, and a protective layer 18 surrounding the outer conductor 17. The outer conductor 17 may comprise braided wire or braided shield 16, metal foil 15, a metal sleeve, or some combination thereof. The cable 10 comprises a prepared end 20, having an exposed outer conductor 22 and an exposed inner conductor 24, suitable for use with the connectors disclosed herein.

FIG. 5 also shows the connector 100 in an uncompressed state, with a coaxial cable 10 inserted therein.

FIG. 6 shows the connector 100 in a fully compressed state and engaging coaxial cable 10. The rear ferrule portion 140 abuts the forward facing shoulder 122 of the outer body 110. The weakened portion 142 has collapsed. The weakened portion 142 can be deformed and/or ruptured. In some embodiments, the weakened portion 142 is broken. In other embodiments, the weakened portion stretches. In some embodiments, the weakened portion 142 is plastically deformed. In the embodiment shown in FIG. 6, at least a rear part of the bushing portion 144 is not longitudinally spaced away from the ferrule portion 140. At least a rear part 150 of the bushing portion 144 is sandwiched between the ferrule portion 140 and the internal surface 118 of the outer body 110, which urges the ferrule portion 140 radially inwardly.

In some embodiments, as shown in FIGS. 5 and 6, at least part of the inner surface 132 of the bushing portion 144 defines an annular space 152 that receives at least part of the outer surface 136 of the rear ferrule portion 140 in the fully compressed state.

In some embodiments, as shown in FIGS. 5-6, the outer surface 136 of the forward conducting portion 146 of the insert 130 comprises at least one circumferential compression groove 154. In the fully compressed state, the forward conducting portion 146 is longitudinally compressed at (or proximate) the circumferential compression groove 154 and the inner surface 132 of the forward conducting portion 146 of the insert 130 at or proximate the circumferential compression groove 154 protrudes radially inwardly at protrusion 156 to grip the exposed outer conductor 22 of the cable 10. The forward conducting portion 146 is brought into tighter gripping engagement with the cable 10. In other embodiments, the inner surface 132 of the forward conducting portion 146 of the insert 130 comprises at least one circumferential compression groove 154 and the forward conducting portion 146 is brought into tighter gripping engagement with the cable 10 in the fully compressed state.

Referring again to FIGS. 5-6, the internal surface 118 of the outer body 110 comprises an inward protrusion 160 disposed between the rear end 112 and the front end 116. The inward protrusion 160 is capable of engaging the outer surface 136 of the insert 130 in order to provide a forward stop to longitudinal movement of the insert 130 toward the front end 116 of the outer body 110.

The inner surface 132 of the insert 130 defines a rearward facing shoulder 162 at or proximate the junction between the bushing portion 144 and the forward conducting portion 146.

As understood from FIGS. 5 and 6, movement of the insert 130 toward the rear end 112 of the outer body 110 causes the rear ferrule portion 140 to engage the forward facing shoulder 122 of the outer body 110, and causes the weakened portion 142 to collapse, by deforming or breaking, which causes the bushing portion 144 to move longitudinally toward the rear end 112 of the outer body 110. Forward conducting portion 146 also moves rearwardly toward the rear end 112 of the body 110. Rear ferrule portion 140 substantially does not move longitudinally during compression.

In some embodiments, the rear ferrule portion 140 comprises a tapered, or conical, outer surface 164 of increasing diameter in the rearward direction, i.e. of decreasing diameter in the forward direction, such that movement of the insert 130 toward the rear end 112 of the outer body 110 causes the rear ferrule portion 140 to engage the forward facing shoulder 122 of the outer body 110, and causes the weakened portion 144 to collapse, i.e. deform or break, and causes the bushing portion 144 to move longitudinally toward the rear end 112 of the outer body 110 and to ride on the tapered or conical outer surface 164 of the rear ferrule portion 140. Engagement of the bushing portion 144 with the rear ferrule portion 140, whether weakened portion 142 is sandwiched therebetween or not, forces rear ferrule portion 140 radially inwardly to grip and compress the protective layer 18 of the cable 10.

In some embodiments, movement of the insert 130 toward the rear end 112 of the outer body 110 causes the forward conducting portion 146 of the insert 130 to longitudinally compress and cause the inner surface 132 of the forward conducting portion 146 of the insert 130 to protrude radially inwardly. The inward radial protrusion 156 increases the surface contact area between portion 146 and the exposed outer conductor 22 of the cable 10 and/or increases the grip of the insert 130 on the exposed outer conductor 22 to help increase the electrical connectivity between the outer conductor 22 and the forward conducting portion 146 of the insert 130. In some embodiments, contact between insert 130 and the exposed outer conductor 22 results in contact between the insert 130 and braided shield 16. In other embodiments, contact between insert 130 and the exposed outer conductor 22 results in contact between the insert 130 and conductive ground foil 15. In other embodiments, contact between insert 130 and the exposed outer conductor 22 results in contact between the insert 130 and conductive ground foil 15 as well. as braided shield 16.

The internal surface 118 of the outer body 110 in some embodiments comprises one or more threads. The internal surface 118 of the outer body 110 comprises at least one thread on at least a portion of the internal surface 110 at or near the front end 116 of the outer body 110. The outer body 110 may then be threadedly engaged to a threaded terminal, or an adapter, or some other threaded device 30 to which the connector 100 is to be coupled. An adapter 30 is shown in FIG. 6 as an illustration. The outer surface of the outer body is provided with a hexagonal configuration or other shape suitable for engagement with a tool serves. The outer body in some embodiments is made integrally of a single unitary piece.

Referring to FIGS. 5-7, the insert 130 fits entirely within the longitudinal opening 120 of the outer body 110 in the uncompressed state, and the insert 130 also fits entirely within the longitudinal opening 120 of the outer body 110 in the fully compressed state. That is, the insert 130 lies between the rear end 112 and front end 116, and outer body 110 completely surrounds and envelopes insert 130. In other embodiments, the insert 130 fits partially within the longitudinal opening 118 of the outer body 110 in the uncompressed state, for example by jutting out beyond front end 116. In some embodiments, the insert 130 fits partially within the longitudinal opening 118 of the outer body 110 in the fully compressed state.

As seen in FIG. 5, in an uncompressed state: the weakened portion 142 is disposed between the ferrule portion 140 and the bushing portion 144; the bushing portion 144 is longitudinally spaced away from the ferrule portion 140; the rear ferrule portion 140, the weakened portion 142 and the bushing portion 144 are disposed between the internal surface 118 of the outer body 110 and the protective layer 18 of the cable 10; and the forward conducting portion 146 is disposed adjacent the exposed outer conductor 24. The forward conducting portion 146 is disposed between the exposed outer conductor 22 and the internal surface 118 of the outer body 110.

As seen in FIG. 6, in a fully compressed state, the rear ferrule portion 144 abuts the forward facing shoulder 122 of the outer body 110, the weakened portion 142 is deformed or broken, and at least part (such as a rear part as illustrated) 150 of the bushing portion 144 is sandwiched between the ferrule portion 140 and the internal surface 118 of the outer body 110, thereby urging the ferrule portion 140 radially inwardly into the protective layer 18 of the cable 10. At least a rear part 150 of the bushing portion 144 is not longitudinally spaced away from the ferrule portion 140.

Referring again to FIGS. 5-6, the protective layer 18 and at least a portion 166 of the internal surface 118 of the outer body 110 define a first annular cavity 168 therebetween. The rear ferrule portion 140, the weakened portion 142, and the bushing portion 144 are disposed in the first annular cavity 168. FIG. 5 shows the rear ferrule portion 140, the weakened portion 142, and the bushing portion 144 disposed in the first annular cavity 168 in the uncompressed state. FIG. 6 shows the rear ferrule portion 140, the weakened portion 142, and the bushing portion 144 disposed in the first annular cavity in the fully compressed state. Also, the exposed outer conductor 22 and at least a portion 170 of the internal surface 118 of the outer body 110 define a second annular cavity 172 therebetween. The forward conducting portion 146 is disposed in the second annular cavity 172. FIGS. 5 and 6 both show the forward conducting portion 146 disposed in the second annular cavity 172.

In some embodiments, as seen in FIG. 6, in the fully compressed state, at least part 156 of the forward conducting portion 146 protrudes radially inwardly against the exposed outer conductor 22 of the cable 10. The outer surface 136 of the forward conducting portion 146 of the insert 130 comprises at least one circumferential compression groove 154, and, in the fully compressed state, the forward conducting portion 146 is longitudinally compressed at or proximate the circumferential compression groove 154 and the inner surface 132 of the forward conducting portion 146 of the insert 130, at or proximate the circumferential compression groove 154, protrudes radially inwardly at protrusion 156 against the exposed outer conductor 22 of the cable 10.

The internal surface 118 of the outer body 110 comprises an inward protrusion 160 disposed between the rear end 112 and the front end 116, wherein the inward protrusion 160 is capable of engaging the outer surface 136 of the insert 130, thereby providing a forward stop to longitudinal movement of the insert 130 toward the front end 116 of the outer body 110. The inner surface 132 of the insert 130 defines a rearward facing shoulder 162 at (or proximate) the junction between the bushing portion 144 and the forward conducting portion 146. The rearward facing shoulder 162 is capable of engaging a front end 19 of the protective layer 18 of the cable 10, and shoulder 162 thereby provides a forward stop to longitudinal movement of the cable 10 toward the front end 116 of the outer body 110.

As understood from FIGS. 5 and 6, movement of the insert 130 toward the rear end 112 of the outer body 110 causes the cable 10 to move toward the rear 112 of the outer body 110, causes the rear ferrule portion 140 to engage the forward facing shoulder 122 of the outer body 110, causes the weakened portion 142 to deform or break, leading to collapse of the insert 130, and causes the bushing portion 144 to move longitudinally toward the rear end 112 of the outer body 110. In some embodiments, the bushing portion 144 moves longitudinally toward the rear end 112 of the outer body 110 and rides on a tapered outer surface 164 of the rear ferrule portion 140. Movement of the insert 130 toward the rear end 112 of the outer body 110 causes the forward conducting portion 146 of the insert 130 to longitudinally compress and causes the inner surface 132 of the forward conducting portion 146 of the insert 130 to protrude radially inwardly and against the exposed outer conductor 22 to help increase electrical connectivity between the exposed outer conductor 22 and the forward conducting portion 146. The forward conducting portion 146 can then contact a corresponding outer conductor portion of a terminal or device 30, as illustrated in FIG. 6.

The inner surface of the forward conducting portion 146 is adapted to allow the exposed outer conductor 22 to pass longitudinally therethrough. In some embodiments, such as shown in FIG. 5, the inner surface 132 of the forward conducting portion 146 is conically tapered, with its internal diameter increasing in the rearward direction. Such a conical taper assists in centering the exposed outer conductor 22 during insertion of the cable 10 into the connector (or engagement of the connector onto the cable 10).

In some embodiments, the insert 130 is easily rotatable with respect to the outer body 110 until the weakened part collapses. Insert 130 can be made free-spinning around outer body 110 before collapse.

Connector 100 can be assembled by placing the insert 130 into the longitudinal opening 120 of the outer body 110, by inserting the rear ferrule portion 140 first, the insert 130 being adapted to flex radially inwardly so as to allow the rear ferrule portion 140, the weakened portion 142, and the bushing portion 144 to pass rearwardly, with respect to outer body 110, under protrusion 160, then to expand so that insert 130 engages protrusion 160.

Representative of a second set of embodiments, connector 100A in FIGS. 9 and 10 is provided with a forward O-ring 180 disposed between the inner surface 118 of the outer body 110 and the outer surface 136 of the insert 130. In some embodiments, the forward O-ring 180 is selected to permit free rotation between body 110 and insert 130 until the insert 130 collapses. As illustrated in FIG. 10, the forward O-ring 180 is compressed between the outer body 110, the insert 130, and the terminal or device 30 to which the connector 100 is being coupled. Compression of the forward O-ring 180 helps to form a 360° environmentally tight seal at or proximate the front end of the connector. In some embodiments, such as depicted in FIGS. 5 and 9, the insert 130 is provided with a front flange 182 extending radially outwardly. The front flange 182 provides a rearward stop to prevent the forward O-ring 180 from moving longitudinally rearward. Forward O-ring 180 can be placed inside longitudinal opening 120 and into contact with insert 130 and/or outer body 110, after insert 130 is assembled into outer body 110.

Representative of a third set of embodiments, connector 100B in FIGS. 11 and 12 is provided with, in addition to a forward O-ring 180, a rear O-ring 186 disposed between the inner surface 118 of the outer body 110 and the rear end of the rear ferrule portion 140 of the insert 130. In some embodiments, the rear O-ring 186 is selected to permit free rotation between body 110 and insert 130 until the insert collapses. As illustrated in FIG. 12, upon compression of the insert 130 against the rear flange 114 of the outer body 110, the rear O-ring 186 is compressed between the outer body 110, the insert 130, and the protective layer 18 of the cable 10. Compression of the rear O-ring 186 helps to form a 360° environmentally tight seal proximate the rear end of the connector 100B. Rear O-ring 186 can be placed inside longitudinal opening 120 and into contact with outer body 110, before insert 130 is assembled into outer body 110.

Representative of a fourth set of embodiments, connector 100C in FIGS. 13 and 14 is provided with, in addition to a rear O-ring 186, a front ring 190 disposed at or proximate the front end 116 of the outer body 110. The front ring 190 is shown in FIGS. 13 and 14 as being disposed forward of the internal threads 200 of the outer body 110. Threaded engagement between the connector 100C and a terminal or other threaded device 30 will sandwich the front ring 190 between the inner surface 118 of the outer body 110 and the terminal or device 30 to help form a 360° environmentally tight seal proximate the front end 116 of the connector 100C. In some embodiments, the front ring 190 is made of ductile material such as plastic.

In some embodiments, the outer body 110 is a single piece unitary body. In embodiments with a rear O-ring 186, the rear O-ring 186 is placed inside the outer body, then At least a portion of the outer surface 117 of the outer body 110 comprises a gripping portion 119 that facilitates gripping the connector. In some embodiments, the outer surface 117 of the outer body 110 comprises a hexagonal outer configuration generally surrounding the outer body 110 as illustrated in FIG. 7. In some embodiments, the hexagonal outer configuration extends longitudinally over a majority (greater than 50%) of the longitudinal length L of the outer body, from the rear end 112 to the front end 116. In other embodiments, the hexagonal outer configuration extends longitudinally over more than 75% of the longitudinal length L of the outer body 110, from the rear end 112 to the front end 116. In still other embodiments, the outer surface 117 of the outer body 110 is provided with a plurality of ridges or grooves, such as a knurled surface. In some embodiments, the outer surface 117 of the outer body 110 comprises a hexagonal outer configuration and a plurality of ridges or grooves. Thus, the outer body 110 can be handled, gripped, and/or rotated, for example to threadedly engage the outer body 110 to a terminal or device 30, and without a separate nut member or other coupler member. An internally threaded outer body 110 thus performs the function of a nut without the need to have a separate nut member. The outer body 110 can thus provide a large gripping portion 119 that facilitates rotation either by hand or by tool, such as a wrench, or by both.

In some embodiments, a connector disclosed herein consists of an outer body 110 and an insert 130. In other embodiments, a connector disclosed herein consists of an outer body 110, an insert 130, and one O-ring disposed within the longitudinal opening 120 of the outer body 110. In still other embodiments, a connector disclosed herein consists of an outer body, an insert, and a plurality of circular rings, such as O-rings, disposed within the longitudinal opening 120 of the outer body 110.

The connector disclosed herein does not require any post or mandrel or other such member that is inserted between the metal foil 15 and braided shield 16, nor between the dielectric 14 and the outer conductor 17 of the cable 10 in order to lift the braided shield 16 or the outer conductor 17 radially outward, i.e. the connector disclosed herein is post-less. Accordingly, minimal pressure is required to insert the cable 10 into the connector disclosed herein (or the connector onto the cable) as compared to known connectors having a post (or mandrel) that must be driven into the cable. Moreover, the connector avoids the lifting up and/or folding back of any part of the outer conductor 17 (such as the braid 16) of the cable 10. The outer conductor 17 is not lifted away from its original position which is concentric with (and parallel to) the inner conductor 12 of the cable 10, i.e. the foil 15 as well as the braid 16 remains concentric with the inner conductor 12 and dielectric 14. No step of preparing the cable by lifting or expanding any part of the outer conductor is required with the connectors and methods disclosed herein.

The connector disclosed herein can be used with various types of coaxial cable, for example cables with relatively stiff cable outer layers such as hard line cable, or for example with cables with relatively soft jackets.

The outer body 110 is made from a rigid material. The outer body 110 can be made from a metallic material, such as brass or aluminum, or from plastic, such as acetyl.

The insert 130 can be made from a metallic material, such as brass or aluminum, or from plastic, but the forward conducting portion 146 is made from a material that conducts electricity well, such as brass. Insert 130 can be made entirely of a single material, such as brass, or insert 130 can be made from a combination of materials; for example, the forward conducting portion 146 can be made of brass, and the rear ferrule portion 140, weakened portion 142, and bushing portion 144 can be made of plastic. In some embodiments, insert 130 can be integrally formed into a single unitary piece. In other embodiments, insert 130 can be assembled from a plurality of sectional parts; for example, rear ferrule portion 140, weakened portion 142, and bushing portion 144 can be formed into a single-piece unitary body made of plastic to provide a first section 131 of the insert 130, and the forward conducting portion 146 can be made of brass to provide a second section 133 of the insert 130, wherein the first and second sections 131, 133 can be placed in proximity within the outer body 110, and the second section of the insert engages protrusion 160 to keep both the first and second sections inside the outer body 110, as shown in FIG. 15. Sections 131 and 133 may be attached to each other, or may remain separate by directly adjacent inside outer body 110, for example forming an insert assembly.

Metal members or portions, such as brass members, can be plated with a conductive, corrosion resistant material, such as nickel, gold, tin, nickel-tin, cadmium or white bronze (copper-zinc-tin).

Referring again now to FIGS. 5 and 6, the prepared end 20 of coaxial cable 10 is inserted into the longitudinal opening 120 at the rear end 112 of outer body 110. Further insertion of the cable 10 is assisted by the conically tapered portion of the inner surface 132 of the forward conducting portion 146. The cable 10 is inserted until the front end 19 of the protective layer 18 of the cable 10 engages the rearward facing shoulder 162 of the insert 130. Insert 130 is prevented from moving forward with respect to the outer body 110 by protrusion 160. Insert 130 is then longitudinally compressed with a force sufficient to collapse weakened portion 142. Insert 130, as well as cable 10, translate rearward with respect to outer body 110 until the bushing portion 144 forces rear ferrule portion 140 into the protective layer 18 of the cable. Longitudinal compression can be effected by using a tool that engages the outer surface 117 at the rear end 112 of outer body 110 simultaneously with the front end 135 of insert 130. Alternatively, longitudinal compression can be effected by engaging the connector 100 onto a terminal or a device 30 which presses on front end 135 of the insert 130; for example, threaded engagement with a threaded terminal brings insert 130 into contact with the terminal, and further threaded advancement onto the terminal forces insert 130 backward into the outer body 110 to compress, and collapse, insert 130.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A connector for attaching to an end of a coaxial cable, the coaxial cable comprising an inner conductor, a dielectric surrounding the inner conductor, an outer conductor surrounding the dielectric, and a protective layer surrounding the outer conductor, the connector comprising:

an outer body comprising a rear end, an inwardly directed rear flange, a front end, a longitudinal axis, and an internal surface extending between the rear and front ends of the body, the internal surface defining a longitudinal opening, wherein the inwardly directed rear flange defines an forward facing shoulder in the internal surface; and a collapsible insert disposed at least partially within the longitudinal opening of the outer body, the insert comprising an inner surface defining a longitudinal opening, an outer surface, a rear ferrule portion, a weakened portion adjacent the rear ferrule portion, a bushing portion adjacent the weakened portion, and a forward conducting portion disposed adjacent the bushing portion;

wherein, in an uncompressed state, the weakened portion is disposed between the ferrule portion and the bushing portion, and the bushing portion is longitudinally spaced away from the ferrule portion;

wherein, in a fully compressed state, the rear ferrule portion abuts the forward facing shoulder of the outer body, the weakened portion is deformed or broken, and at least a part of the bushing portion is sandwiched between the ferrule portion and the internal surface of the outer body, thereby urging the ferrule portion radially inwardly.

2. The connector of claim 1 wherein at least a rear part of the bushing portion is not longitudinally spaced away from the ferrule portion.

3. The connector of claim 1 wherein movement of the insert toward the rear end of the outer body causes the rear ferrule portion to engage the forward facing shoulder of the outer body, and causes the weakened portion to deform or to break, and causes the bushing portion to move longitudinally toward the rear end of the outer body.

4. The connector of claim 1 wherein movement of the insert toward the rear end of the outer body causes the rear ferrule portion to engage the forward facing shoulder of the outer body, and causes the weakened portion to deform or to break, and causes the bushing portion to move longitudinally toward the rear end of the outer body and to ride on the tapered or conical outer surface of the rear ferrule portion.

5. The connector of claim 1 wherein movement of the insert toward the rear end of the outer body causes the forward conducting portion of the insert to longitudinally compress and cause the inner surface of the forward conducting portion of the insert to protrude radially inwardly.

6. The connector of claim 1 wherein the insert fits entirely within the longitudinal opening of the outer body in the uncompressed state.

7. The connector of claim 1 wherein the insert fits entirely within the longitudinal opening of the outer body in the fully compressed state.

8. A connector in combination with a coaxial cable, the coaxial cable comprising an inner conductor, a dielectric surrounding the inner conductor, an outer conductor surrounding the dielectric, and a protective layer surrounding the outer conductor, the protective layer having an outermost cable diameter, the cable further comprising a prepared end having an exposed outer conductor and an exposed inner conductor, the combination comprising:

an outer body comprising a rear end, an inwardly directed rear flange, a front end, a longitudinal axis, and an internal surface extending between the rear and front ends of the body, the internal surface defining a longitudinal opening adapted to receive the cable and comprising at least one thread on at least a portion of the internal surface adjacent the front end of the outer body, wherein the inwardly directed rear flange defines an forward facing shoulder in the internal surface; and a collapsible insert disposed at least partially within the longitudinal opening of the outer body, the insert comprising an inner surface defining a longitudinal opening, an outer surface, a rear ferrule portion, a weakened portion adjacent the rear ferrule portion, a bushing portion adjacent the weakened portion, and a forward conducting portion disposed adjacent the bushing portion;

wherein, in an uncompressed state: the weakened portion is disposed between the ferrule portion and the bushing portion; the bushing portion is longitudinally spaced away from the ferrule portion; the rear ferrule portion, the weakened portion and the bushing portion are disposed between the internal surface of the outer body and the protective layer of the cable; and the forward conducting portion is disposed adjacent the exposed outer conductor;

wherein, in a fully compressed state, the rear ferrule portion abuts the forward facing shoulder of the outer body, the weakened portion is deformed or broken, and at least a rear part of the bushing portion is sandwiched between the ferrule portion and the internal surface of the outer body, thereby urging the ferrule portion radially inwardly into the protective layer of the cable.

9. The combination of claim 8 wherein, in the fully compressed state, at least part of the forward conducting portion protrudes radially inwardly against the exposed outer conductor of the cable.

10. The combination of claim 8 wherein the inner surface of the insert defines a rearward facing shoulder at or proximate the junction between the bushing portion and the forward conducting portion.

11. The combination of claim 10 wherein the rearward facing shoulder is capable of engaging a front end of the protective layer of the cable, thereby providing a forward stop to longitudinal movement of the cable toward the front end of the insert.

12. The combination of claim 8 wherein movement of the insert toward the rear end of the outer body causes the cable to move toward the rear of the outer body, causes the rear ferrule portion to engage the forward facing shoulder of the outer body, causes the weakened portion to deform or break, and causes the bushing portion to move longitudinally toward the rear end of the outer body.

13. The combination of claim 8 wherein movement of the insert toward the rear end of the outer body causes the cable to move toward the rear of the outer body, causes the rear ferrule portion to engage the forward facing shoulder of the outer body, causes the weakened portion to deform or break, and causes the bushing portion to move longitudinally toward the rear end of the outer body and to ride on the tapered or conical outer surface of the rear ferrule portion.

14. The combination of claim 8 wherein movement of the insert toward the rear end of the outer body causes the forward conducting portion of the insert to longitudinally compress and cause the inner surface of the forward conducting portion of the insert to protrude radially inwardly and against the exposed outer conductor.

15. A connector for attaching to an end of a coaxial cable, the coaxial cable comprising an inner conductor, a dielectric surrounding the inner conductor, an outer conductor surrounding the dielectric, and a protective layer surrounding the outer conductor, the connector comprising:

an outer body comprising a rear end, an inwardly directed rear flange, a front end, a longitudinal axis, and an internal surface extending between the rear and front ends of the body, the internal surface defining a longitudinal opening and having at least one thread on at least a portion of the internal surface adjacent the front end of the outer body, wherein the inwardly directed rear flange defines an forward facing shoulder in the internal surface; and a collapsible insert disposed at least partially within the longitudinal opening of the outer body, the insert comprising an inner surface defining a longitudinal opening, an outer surface, a rear ferrule portion, a bushing portion, a weakened portion disposed between the ferrule portion and the bushing portion, and a forward conducting portion disposed adjacent the bushing portion;

wherein, in an uncompressed state, the weakened portion is disposed between the ferrule portion and the bushing portion, and the bushing portion is longitudinally spaced away from the ferrule portion;

wherein the insert is capable of abutting the forward facing shoulder of the outer body, wherein, in a fully compressed state, the rear ferrule portion abuts the forward facing shoulder of the outer body, the weakened portion is deformed or broken, at least a rear part of the bushing portion is not longitudinally spaced away from the ferrule portion, and at least a rear part of the bushing portion is sandwiched between the ferrule portion and internal surface of the outer body, thereby urging the ferrule portion radially inwardly.

* * * * *